United States Patent [19]

Yoo

[11] 4,337,144

[45] Jun. 29, 1982

[54] ALUMINUM PASSIVATION PROCESS

[75] Inventor: Jin S. Yoo, Flossmoor, Ill.

[73] Assignee: Atlantic Richfield Company, Philadelphia, Pa.

[21] Appl. No.: 150,851

[22] Filed: May 19, 1980

[51] Int. Cl.[3] ..... C10G 11/04; C10G 11/18

[52] U.S. Cl. ..... 208/120; 208/52 CT; 208/113; 252/420; 252/455 Z

[58] Field of Search ..... 208/52 CT, 113–124; 252/411 R, 420

[56] References Cited

U.S. PATENT DOCUMENTS

| | | | |
|---|---|---|---|
| 2,480,627 | 8/1949 | Bodkin et al. | 252/412 |
| 2,850,462 | 9/1958 | Plank | 252/411 |
| 3,158,565 | 11/1964 | Sanford et al. | 208/120 |
| 3,324,044 | 6/1967 | Oberhofer | 252/413 |
| 4,101,444 | 7/1978 | Burk et al. | 208/120 X |
| 4,115,249 | 9/1978 | Blanton et al. | 208/120 |
| 4,259,175 | 3/1981 | McArthur | 208/113 |

*Primary Examiner*—Delbert E. Gantz
*Assistant Examiner*—G. E. Schmitkons
*Attorney, Agent, or Firm*—Stanley M. Welsh

[57] ABSTRACT

A passivation process for decreasing the poisonous effects from contamination by metals that can occur during the catalytic conversion of hydrocarbon feedstocks containing such metals is disclosed. The process employs compositions of organic or aqueous media containing one or more at least partially soluble species of aluminum.

13 Claims, No Drawings

ALUMINUM PASSIVATION PROCESS

BACKGROUND OF THE INVENTION

This invention relates to a process for reducing poisonous effects of metal contaminants such as iron, nickel, vanadium and the like, picked up by a hydrocarbon conversion catalyst during a hydrocarbon conversion process such as the high temperature conversion of a hydrocarbon feedstock containing such metals to a lower boiling product. More particularly, this invention relates to processes for reducing the poisonous effects of metal contaminants without removal of such contaminants from the catalyst, e.g., by a process of passivation.

During a catalyst promoted chemical conversion involving a hydrocarbon containing metal contaminants such as iron, nickel, and vanadium, the catalyst may become more and more deactivated due to the pick up of at least a portion of the metal poisons. Removal of such poisons from the catalyst may restore a substantial amount of the catalytic activity. However, no matter how carefully the process for removing the metal poisons from the catalyst is carried out, some penalty in the form of overall performance is often paid. Accordingly, a simple and straight forward method for overcoming the deleterious effects of the metal poisons or contaminants is desirable.

U.S. Pat. No. 3,324,044 (1967) discloses a method for restoring the catalytic activity of silica-alumina catalysts that are contaminated with metals such as iron, nickel and vanadium. The method involves removal of metal-contaminants from such catalysts by treating them at a temperature of at least 150° F. for at least 30 minutes with diluted aqueous solutions, which contain not more than 5% by weight of a water-soluble acidic aluminum salt and have a pH of from 2.0 to 5.5

Catalytically promoted methods for the chemical conversion of hydrocarbons include cracking, hydrocracking, reforming, hydrodenitrogenation, hydrodesulfurization, etc. Such reactions generally are performed at elevated temperatures, for example, about 300° to 1200° F., more often 600° to 1000° F. Feedstocks to these processes comprise normally liquid or solid hydrocarbons which, at the temperature of the conversion reaction, are generally in a fluid, i.e., liquid or vapor, state and the products of the conversion usually are more valuable, lower boiling materials.

Although referred to as "metals", these catalyst contaminants may be present in the hydrocarbon feed in the form of free metals or relatively non-volatile metal compounds. It is, therefore, to be understood that the term "metal" as used herein refers to either form. Various petroleum stocks have been known to contain at least traces of many metals. For example, Middle Eastern crudes contain relatively high amounts of several metal components, while Venezuelan crudes are noteworthy for their vanadium content and are relatively low in other contaminating metals such as nickel. In addition to metals naturally present in petroleum stocks, including some iron, petroleum stocks also have a tendency to pick up tramp iron from transportation, storage and processing equipment. Most of these metals, when present in a stock, deposit in a relatively nonvolatile form on the catalyst during conversion processes so that regeneration of the catalyst to remove deposited coke does not also remove these contaminants. With the increased importance of gasoline in the world today and the shortages of crude oils and increased prices, it is becoming more and more important to process any type or portions of a crude source, including those highly metal contaminated crudes to more valuable products.

Of the various metals which are to be found in representative hydrocarbon feedstocks some, like the alkali metals, only deactivate the catalyst without changing the product distribution; therefore, they might be considered true poisons. Others such as iron, nickel, vanadium, and copper markedly alter the selectivity and activity of cracking reactions if allowed to accumulate on the catalyst and, since they affect process performance, they are also referred to as "poisons". A poisoned catalyst with these metals generally produces a higher yield of coke and hydrogen at the expense of desired products, such as gasoline and butanes. For instance, U.S. Pat. No. 3,147,228 reports that it has been shown that the yield of butanes, butenes and gasoline, based on converting 60 volume percent of cracking feed to lighter materials and coke dropped from 58.5 to 49.6 volume percent when the amount of nickel on the catalyst increased from 55 ppm to 645 ppm and the amount of vanadium increased from 145 ppm to 1480 ppm in a fluid catalytic cracking of a feedstock containing some metal contaminated stocks. Since many cracking units are limited by coke burning or gas handling facilities, increased coke or gas yields require a reduction in conversion or throughput to stay within the unit capacity.

The present invention is particularly suitable for passivating poisons in a catalyst utilized in the catalytic cracking of reduced or topped crude oils to more valuable products such as illustrated in U.S. Pat. Nos. 3,092,568 and 3,164,542. The teachings of which are incorporated by reference herein. Similarly, this invention is applicable to processing shale oils, tar sands oil, coal oils and the like where metal contamination of the processing, e.g., cracking, catalyst can occur.

BRIEF DESCRIPTION OF THE INVENTION

It is an object of this invention to improve the performance of a hydrocarbon conversion catalyst by reducing the poisonous effects of metals present in a hydrocarbon feedstock.

It is an object of this invention to provide a simple and straight forward process for reducing the poisonous effects on a chemical conversion catalyst due to metal contaminants present in a hydrocarbon feedstock than would otherwise occur during a chemical conversion process of such a hydrocarbon feedstock.

Other objects of this invention will be clear based upon this disclosure.

An alternative to letting the unpassivated metals level of a conversion catalyst increase and activity and desired selectivity decrease is to diminish the overall unpassivated metals content on the catalyst by raising catalyst replacement rates. Either approach, letting unpassivated metals level increase, or increasing catalyst replacement rates, must be balanced against product value and operating costs to determine the most economic way of operating. The optimum unpassivated metals level at which to operate any cracking unit will be a function of many factors including feedstock metal content, type and cost of catalyst, overall refinery balance, etc., and can be determined by a comprehensive study of the refinery's operations. With the high cost of both catalyst and the hydrocarbon feedstock today, it is increasingly disadvantageous to discard catalyst or convert hydrocarbon feedstocks to coke or gas.

It has been discovered that treating a conversion catalyst containing a metal contaminant such as iron, copper, nickel and/or vanadium with aluminum compounds and preferably followed by calcination, the apparent poisonous effects of freshly deposited metal contaminants upon a hydrocarbon conversion catalyst are significantly reduced. Several methods for treating such a contaminated catalyst have been found to be surprisingly effective.

Solid oxide catalysts have long been recognized as useful in catalytically promoting the conversion of hydrocarbons. For hydrocarbon cracking processes carried out in the substantial absence of added free molecular hydrogen, suitable catalysts which are usually activated or calcined, are predominately silica or silica-based, e.g., silica-alumina, silica-magnesia, silica-zirconia, etc., compositions in a state of slight hydration containing small amounts of acidic oxide promoters in many instances. The oxide catalyst may contain a substantial amount of a gel or gelatinous precipitate comprising a major portion of silica and at least one other inorganic oxide material, such as alumina, zirconia, etc. These oxides may also contain small amounts of other inorganic materials. The use of wholly or partially synthetic gel or gelatinous catalyst, which are uniform and little damaged by high temperatures in treatment and regenerating, is often preferable.

Also suitable are hydrocarbon cracking catalysts which include a catalytically effective amount of at least one natural or synthetic zeolite, e.g., crystalline alumino silicate. A preferred catalyst is one that includes at least one zeolite to provide a high activity catalyst. Suitable amounts of zeolite in the catalyst are in the range of about 1–75% by weight. Preferred are zeolite amounts of about 2–30% by weight of the total catalyst. Catalysts which can withstand the conditions of both hydrocarbon cracking and catalyst regenerating are suitable for use in the process of this invention. For example, a phosphate silica-alumina silicate composition is shown in U.S. Pat. No. 3,867,279, chrysotile catalysts are shown in U.S. Pat. No. 3,868,316, zeolite beta type of catalyst is shown in U.S. Pat. No. Re. 28,341. The catalyst may be only partially of synthetic material; for example, it may be made by the precipitation of silica-alumina on clay, such as kaolinite or halloysite. One such semi-synthetic catalyst contains about equal amounts of silica-alumina gel and clay.

The manufacture of synthetic gel catalyst is conventional, well known in the art and can be performed, for instance (1) by impregnating silica with aluminia salts; (2) by direct combination of precipitated (or gelated) hydrated alumina and silica in appropriate proportions; or (3) by joint precipitation of alumina and silica from an aqueous solution of aluminum and silicon salts. Synthetic catalyst may be produced by a combination of hydrated silica with other hydrate bases as, for instance, zirconia, etc. These synthetic gel-type catalysts may be activated or calcined before use.

A particularly preferred catalyst contains a catalytically effective amount of a decationized zeolite molecular sieve having less than 90% of the aluminum atoms associated with cations, a crystalline structure capable of internally absorbing benzene and a $SiO_2$ to $Al_2O_3$ molar ratio greater than 3. Such catalysts are illustrated in U.S. Pat. No. 3,236,761, the teachings of which are incorporated by reference herein.

The physical form of the catalyst is not critical to the present invention and may, for example, vary with the type of manipulative process in which it will be used. The catalyst may be used as a fixed bed or in a circulating system. In a fixed-bed process, a single reaction zone or a series of catalytic reaction zones may be used. If a series of reactors are used, one is usually on stream and others are in the process of cleaning or regenerating and the like. In circulating catalyst systems, such as those of the fluid bed or moving bed catalytic processes, catalyst moves through a reaction zone and then through a regeneration zone. In a fluid bed cracking process, gases are used to convey the catalyst and to keep it in the form of a dense turbulent bed which has no definite upper interface between the dense (solid) phase the suspended (gaseous) phase mixture of catalyst and gas. This type of processing requires the catalyst to be in the form of a fine powder, e.g., a major amount by weight of which being in a size range of about 20 to 150 microns. In other processes, e.g., moving bed catalytic cracking system, the catalyst can be in the form of macrosize particles such as spherical beads which are conveyed between the reaction zone and the catalyst regeneration zone. These beads may range in size up to about ½" in diameter. When fresh, the minimum size bead is preferably about ¼". Other physical forms of catalyst such as tablets, extruded pellets, Microspheroids (5–100), etc. can be used.

In this invention, the hydrocarbon petroleum oils utilized as feedstock for a given conversion process may be of any desired type normally utilized in such hydrocarbon conversion operations. The feedstock may contain nickel, iron and/or vanadium as well as other metals. As indicated, the catalyst may be used to promote the desired hydrocarbon conversion by employing at least one fixed bed, moving bed or fluidized bed (dense or dilute phase) of such catalyst. Bottoms from hydrocarbon processes, (i.e., reduced crude and residuum stocks) are particularly highly contaminated with these metals and therefore rapidly poison catalysts used in converting bottoms to more valuable products. For example, a bottom may contain about 100–500 ppm Ni, about 100–2500 ppm V and about 100–3000 ppm Fe. For typical operations, the catalytic cracking of the hydrocarbon feed would often result in a conversion of about 10 to 80% by volume of the feedstock into lower boiling, more valuable products.

A unique feature of this invention involves a transfer of aluminum-containing species from a treating medium to a catalyst poisoned by metal contaminants. As a result of such transfer, rather than demetallization as disclosed in U.S. Pat. No. 3,324,044 (1967) discussed hereinbefore, the deleterious effects from the metal contaminants are surprisingly reduced.

Broadly, this invention is an improvement to a conventional conversion process. A conventional conversion process involves contacting a hydrocarbon feedstock in a reaction zone at hydrocarbon conversion conditions with a catalyst to form a conversion product and a deactivated catalyst which has carbonaceous deposits and contains at least a portion of the metal contaminants originally present in the hydrocarbon feedstock. The deactivated catalyst is typically regenerated to restore at least a portion of its catalytic activity by removing under controlled conditions at least a portion of said carbonaceous deposits to form a regenerated catalyst.

An example of a conversion process is cracking of hydrocarbon feedstocks to produce hydrocarbons of preferred octane rating boiling in the gasoline range. A variety of solid oxide catalysts is widely used to give end products of fairly uniform composition. Cracking is ordinarily effected to produce gasoline as the most valuable product and is generally conducted at temperatures of about 750° to 1100° F., preferably about 850° to 950° F., at pressures up to about 2000 psig, preferably about atmospheric to 100 psig and without substantial addition of free hydrogen to the system. In cracking, the feedstock is usually a petroleum hydrocarbon fraction such as straight run or recycle gas oils or other normally liquid hydrocarbons boiling above the gasoline range. Recently, low severity cracking conditions have been employed for heavily contaminated feedstocks such as crude or reduced crude where the conversion is not made directly to the most valuable, lower boiling products, i.e., gasoline boiling range products, but to intermediate type hydrocarbon conversion products which may be later refined to the more desirable, lower boiling, gasoline or fuel oil fractions. High severity cracking has also been practiced for the conversion of such feedstocks to light, normally gaseous hydrocarbons, such as ethane, propane or butane.

An example of a regeneration procedure is one wherein the catalyst is contacted periodically with free oxygen-containing gas in order to restore or maintain the activity of the catalyst by removing at least a portion of the carbonaceous deposits from the catalyst which form during hydrocarbon conversion. However, in those processes not having a regeneration step, the catalyst can be subjected to a regenerating step after the removal of the catalyst from the process. It will be understood that "regeneration" involves a carbonaceous material burn-off procedure. Ordinarily, the catalyst is taken from the hydrocarbon conversion system and treated before the poisoning metals have reached an undesirably high level, for instance, above about 0.5% by weight, on catalyst and preferably less than about 10% maximum, content of nickel, iron and vanadium. More preferably, the catalyst is removed when the nickel, iron, and vanadium content is less than about 5% by weight and most preferably when the catalyst contains about 0.75% to about 2% by weight nickel, iron, and vanadium. Generally speaking, when the hydrocarbon conversion levels, i.e., more than about 50% by volume (of the feedstock) conversion, the amount of metals tolerated on the catalyst is less. On the other hand, low conversion levels, i.e., less than about 50% by volume conversion, tolerate higher amounts of metals on the catalyst.

The actual time or extent of the regeneration thus depends on various factors and is dependent on, for example, the extent of metals content in the feed, the level of conversion, unit tolerance for poison, the sensitivity of the particular catalyst toward the passivation procedure used to reduce the poisonous effects of metals upon the catalyst, etc.

Regeneration of a hydrocarbon cracking catalyst to remove carbonaceous deposit material is conventional and well known in the art. For example, in a typical fluidized bed cracking unit, a portion of catalyst is continually being removed from the reactor and sent to the regenerator for contact with an oxygen-containing gas at about 950° to about 1220° F., preferably about 1000 to about 1150° F. Combustion of carbonaceous deposits from the catalyst is rapid, and, for reasons of economy, air is used to supply the needed oxygen. Average residence time for a catalyst particle in the regenerator can be on the order of about three to one hundred minutes, preferably about three minutes to sixty minutes and the oxygen content of the effluent gases from the regenerator is desirably less than about 0.5 weight percent. When later oxygen treatment is employed, the regeneration of any particular quantity of catalyst is generally regulated to give a carbon content remaining on the catalyst of less than about 0.5 weight percent. As least a portion of the regenerated catalyst is then returned to the reaction zone.

Calcination of a hydrocarbon cracking catalyst involves heating at high temperatures, e.g., 950° to 1200° F., in a molecular oxygen-containing gas. The temperature preferably is at least about 50° F. higher than the regeneration temperature, but below a temperature where the catalyst undergoes any substantial deleterious change in its physical or chemical characteristics. The catalyst is in a substantially carbon-free condition during a calcination treatment, because the burning off of any significant amount of carbon on the catalyst would lead to, at least in the area where such carbon was located, the evolution of such amounts of heat energy that the catalyst near such evolution of heat energy would very likely be damaged.

The improved process of this invention comprises: contacting a regenerated catalyst with a liquid medium containing an effective amount, to be discussed in more detail hereinafter, of one or more aluminum compounds which are at least in part soluble within said liquid medium. The time of contacting is sufficient to permit a sufficient amount of the aluminum compounds to react with said regenerated catalyst to form a treated catalyst and optionally, but preferably, separating the treated catalyst from at least a portion of said liquid medium and transferring at least a portion of the treated catalyst to a reaction zone. The transfer of treated catalyst to the reaction zone is intended to include both direct and/or indirect transfer to the reaction zone. For example, the treated catalyst can be returned to the regenerator, or a zone for calcination, or to the hydrocarbon feedstock prior to and/or substantially simultaneously with that feedstock being introduced into the reaction zone. The time of contact is sufficient to permit a sufficient amount of the aluminum compounds to react with said regenerated catalyst to form a treated catalyst.

The effective amount of one or more aluminum compounds dissolved in the liquid medium cannot be precisely defined, but it is preferably an amount which results in the treated catalyst having an atomic ratio of aluminum atoms, from said one or more aluminum compounds, to total number of atoms of metal contaminants in the catalyst in the range of about 0.01 to about 3, and preferably in the range of about 0.05 to about 1. Atomic ratio of a first specie to a second specie means, throughout this specification and claims, the ratio of the total number of atoms of the first specie, regardless of any oxidation state or states therein, to the total number of atoms of the second specie, regardless of any oxidation state or states therein.

For example, when the concentration of contaminating metals, calculated as a respective element thereof, in the catalyst is within the range of about 0.2% to about 3.5% by weight, as based upon the total weight of the catalyst, a particularly useful liquid, e.g., water, medium concentration in moles/liter of aluminum species, calculated as based on elemental aluminum, is adjusted to be in the range of about 0.03 moles/liter to about 1 mole/liter of aluminum. The percent by weight of catalyst in a slurry of such a liquid medium is not critical, but is preferably in the range of about 10 to 40 percent by weight.

The liquid medium referred to above can be either an aqueous medium or an organic medium. Both the aqueous medium and the organic medium should be substantially free from contaminating metals such as discussed earlier. The term, "substantially free" means, throughout this specification and claims, present in a concentration sufficiently low so as not to contaminate a catalyst treated by such a medium to a degree that measurably and adversely degrades the selectivity and/or activity of the catalyst so treated. Examples of such aqueous media are distilled water and deionized water. Examples of suitable organic media are petroleum distillates, liquid hydrocarbons, such as benzene, toluene, naphthenes and the like.

Examples of suitable aluminum compounds which have been found particularly effective in an aqueous solution treatment of a conversion catalyst are: $Al(NO_3)_3$, $Al_2(SO_4)_3$, $AlPO_4$, $Al(C_6H_5O)_3$, $Al(Ac)_3$ wherein Ac is acetate, $(NH_4)Al(SO_4)_2$, $(Al(BrO_3)_3$, $Al(ClO_3)_3$, $Al(ClO_4)_3$, $Al(C_2H_5O)_3$, Al-lactate, Al-oleate and $AlX_3$ where each X is individually selected from the group of halogens consisting of F, Cl, Br and I.

Generally, any aluminum compound which is at least partially soluble or sparingly soluble in an organic medium can be used to contact a regenerated catalyst or which is soluble or sparingly soluble in the hydrocarbon feed can be used. For a material to be sparingly soluble in a solvent means at least 0.01 grams of that material can be dissolved in 100 milliliters of solvent. Some examples of organic compounds that can be used are: diketonates; sulfonates; dithiophosphates; alkoxides; carboxylates having from 1 to 20 carbon atoms; such as stearates and oleates; phenoxides; naphthenates; aluminum hydrocarbyls, such as alkyls consisting of hydrogen and carbon, having the formula $R_3Al$ wherein each R individually contains from 1 to 20 carbon atoms; organic aluminum halides having the formula $R_nAlX_{3-n}$ wherein n can have values of 1 or 2 and each R is individually selected from a group consisting of hydrocarbyl and halogen substituted hydrocarbyl material having up to 20 carbon atoms wherein the halogen is individually selected from fluorine, chlorine, bromine and iodine; organic oxyaluminum having the formula $R_nAl(R'O)_{3-n}$ wherein each R and R' individually is selected from a group consisting of hydrocarbyl and halogen substituted hydrocarbyl materials having from 1 to 20 carbon atoms and wherein n is an integer in the range of from 0 to 3; carbonyls, metallocenes, hydrocarbyl, such as alkyl and aryl and halogen substituted hydrocarbyl phosphine and phosphite complexes wherein the hydrocarbyl has 1 to 20 carbon atoms; aluminum oxalates; aluminum acetates; aluminum diethylmalonate; aluminum 1-phenolsulfonates and aluminum halides wherein the halide is selected from a group of halides consisting of fluorine, chlorine, bromine, iodine and mixtures thereof.

Another advantageous method for treating a metal contaminated catalyst with one or more aluminum compounds in an aqueous phase is to induce a phase separation of the aluminum-containing species or materials from the aqueous phase. An example of an effective means for inducing such a phase separation is to precipitate at least a portion of the aluminum-containing materials by adjusting the pH range of the aqueous phase. The precipitate includes several important hydrated forms of alumina, AlOOH boehmite and naturally occurring mineral forms, along with a true hydroxide, $Al(OH)_3$. For example, a pH change of the aqueous phase from a value in the range of about 2 to about 5 to a value in the range of about 7 to about 8 has been found particularly effective.

In still another method, a conventional conversion process is improved by contacting a regenerated catalyst with an organic solution containing an effective amount of one or more aluminum compounds dissolved therein. The treated catalyst is then separated from the organic liquid and optionally calcined before being returned, e.g., directly or indirectly, as discussed earlier, to the reaction zone. Two examples of methods for separating the treated catalyst from the organic phase are evaporation of the organic phase or filtration.

A suitable calcining temperature for a treated catalyst is generally in the range of about 900° F. to about 1450° F. and more preferably in the range of about 950° F. to about 1250° F. One limitation on the temperature for calcination is due to the fact that the catalyst must not be adversely affected from heating.

In still another method for passivating the poisonous effects of metal contaminants on a conversion catalyst is to introduce into a hydrocarbon feed of a conventional conversion process at least one partially soluble aluminum compound before, after or substantially simultaneous with contacting said catalyst in said reaction zone. It this method there is no need to separately calcine the catalyst as the substantially simultaneous deposition of both aluminum and other metal contaminants within the hydrocarbon feedstock have been found to surprisingly work together to maintain the activity of the conversion catalyst. The atomic ratio of all aluminum atoms to all metal contaminants in the hydrocarbon feed has an impact upon the observed results. For example, if the ratio is much in excess of 3, then the catalytic activity of the catalyst will be adversely affected. If, on the other hand, the ratio is much less than about 0.05, then the observed benefits are correspondingly lessened. Generally, some benefits of this invention are obtained when the atomic ratio of all aluminum atoms to all metal contaminants in the hydrocarbon feed is in the range of about 0.05 to about 3, and preferably when the ratio is in the range of about 0.3 to about 1.

Examples of processing conditions useful in carrying out a process of this invention are set out hereinafter. Contacting times between a catalyst and a liquid medium for aqueous media are generally in the range of from about half a second to about twenty minutes and preferably in the range of from about two minutes to about ten minutes. Contacting times for an organic medium is about the same as for an aqueous medium, but often depends upon the rate at which the organic medium can be evaporated off, and hence does not have a simply definable contacttng time. The temperature of the contacting medium, e.g., organic and aqueous media, can be any where from about ambient or room temperature (72° F.) to the boiling point of the contacting medium. Temperature is not critical and may, in fact, be below room temperature, but we have found no reason for cooling in order to obtain the benefits from a process of this invention.

It has further been found that contact with oxidative washes, i.e., an aqueous solution containing an oxidizing agent or an agent capable of accepting electrons, has a beneficial effect of further improving the catalytic activity of an aluminum-treated or aluminum passivated conversion catalyst which contains metal contaminants. The "wash" refers to a treatment which may be carried out in a variety of ways, e.g., batch operation, semi-continuous or continuous operation with or without counter currents. The aluminum passivated catalyst is contacted with the oxidative wash solution for a time sufficient to cause an interaction between the solution and catalyst that results in a measurable benefit. The amount of metal contaminants removed from the conversion catalyst by these oxidative washes is generally very small and apparently works by a mechanism different from that of a demetallization process such as disclosed in U.S. Pat. Nos. 4,102,811 (1978); 4,163,709 (1979), and 4,163,710 (1979), which patents are expressly incorporated herein by reference.

A preferred oxidative wash medium comprises a solution of hydrogen peroxide in water. Other oxidizing agents which may be used include air, oxygen, ozone, perchlorates, organic hydroperoxides, organic peroxides, organic peracids, inorganic peroxyacids such as peroxymonosulfuric and peroxydisulfuric acid, singlet oxygen, $NO_2$, $N_2O_4$, $N_2O_3$, superoxides and the like. Typical examples of organic oxidants are hydroxyheptyl peroxide, cyclohexanone peroxide, tertiary butyl peracetate, di-tertiary butyl diperphthalate, tertiary butyl perbenzoate, methyl ethyl hydroperoxide, di-tertiary butyl peroxide, p-methyl benzene hydroperoxide, naphthylhydroperoxide, tertiary butyl hydroperoxide, pinane hydroperoxide, 2,5-dimethylhexane-2,5-dihydroperoxide, cumene hydroperoxide, tertiary butyl hydroperoxide and the like; as well as organic peracids such as performic acid, peracetic acid, trichloroperacetic acid, perchloric acid, periodic acid, perbenzoic acid, perphthalic acid and the like including salts thereof. Ambient oxidative wash temperatures can be used, but temperatures of about 150° F. to the boiling point of the aqueous solution in combination with agitation are helpful in increasing dispersibility or removability of the metal poisons. Preferred temperatures are about 68° F. to about 203° F.

The hydrogen peroxide solution preferably containing about 2 to 30 weight % hydrogen peroxide, can be added to an queous catalyst slurry as described earlier at about 68°-203° F., preferably 77°-185° F. and allowed to react for a time sufficient to provide a useful results. Preferred wash times are about 1-5 minutes. A concentration of $H_2O_2$ in the range of about 5-50 lb., preferably about 10-20 lb. of $H_2O_2$/ton of catalyst is preferably used. Additional oxidative washes can be used to ensure the restoration of catalytic properties. In addition, the oxidative washing can be carried out either in the presence of or absence of a mineral acid such as HCl, $HNO_3$ or $H_2SO_4$. Preferably the pH of the oxidative wash medium is about 2 to about 7. U.S. Pat. No. 4,101,444 (1978) discloses suitable oxidative washes and is expressly incorporated herein by reference.

After the catalyst is washed, the catalyst slurry can be filtered to give a cake. The cake may be reslurried one or more times with water or rinsed in other ways, such as, for example, by a water wash of the filter cake.

After the washing and rinsing treatment, the catalyst is transferred to a hydrocarbon conversion system, for instance, to a catalyst regenerator. The catalyst may be returned as a slurry in the final aqueous wash medium, or it may be desirable first to dry the catalyst filter cake or filter cake slurry at, for example, about 215° F. to 320° F., under a vacuum. Also, prior to reusing the catalyst in the conversion operation it can be calcined, for example, at temperatures usually in the range of about 700° F. to about 1300° F. The catalyst may also be slurried with hydrocarbons and added back to the reactor vessel, if desired.

The following examples are intended to be illustrative of the invention of this disclosure. However, many variations based on the teachings of this disclosure are readily apparent to one skilled in the art and are intended to be within the scope of this invention. The examples should not be used to unnecessarily restrict the nature and scope of this invention.

EXAMPLE I

A Phillips Borger equilibrium silica-alumina zeolite-containing catalyst is used. This catalyst includes about 5% by weight of a crystalline aluminum silicate effective to promote hydrocarbon cracking having an initial catalytic activity as follows:

| | Catalytic Activity | | |
|---|---|---|---|
| | MA | CPR | $H_2/CH_4$ |
| Original Catalyst | 80 | 0.75 | 8 |

The catalyst was used in a fluid catalytic cracking conversion of a hydrocarbon feedstock containing iron, nickel, copper, and vanadium. The contaminated catalyst was removed from the hydrocarbon conversion stream and regenerated to remove carbon under conventional regeneration conditions, so as to have less than about 0.5% by weight of carbon. The regenerated catalyst had a catalytic activity, surface area in units of square meters per gram and a metal contamination shown in the following:

| % Metal Contaminants | | | Catalytic Activity | | | *Surface Area | |
|---|---|---|---|---|---|---|---|
| Ni | Fe | V | MA | CPF | $H_2/CH_4$ | Total | Zeolite |
| 0.33 | 0.72 | 0.71 | 59.1 | 3.02 | 20.0 | 99 | 22 |

*Areas in square meters per gram were determined by nitrogen adsorption according to ASTM D3663 (1978). Total areas were calculated by the BET method, zeolite areas were calculated following a procedure disclosed by M. F. L. Johnson in The Journal of Catalysis, 1978, V. 52, pg. 425.

20 grams of the regenerated equilibrium catalyst was added to 80 mls of an aluminum nitrate solution. The aluminum nitrate solution contains 2.43 grams of aluminum nitrate, $Al(NO_3)_3\ 9H_2O$, dissolved in 80 grams of water which had a pH adjusted to 3.5 to 7.05 by suitable addition of potassium hydroxide. The 20% by weight aqueous slurry produced was agitated for about 40 minutes at ambient temperature (about 72° F.). The catalyst was separated by filtration from a clear supernatent liquid. The catalyst was then air dried in an oven for about 12 hours at a temperature in the range of about 176° F. to about 212° F. The oven dried catalyst was then calcined by heating in an oven which was at an initial temperature of about 72° F. and heated over a period of about 30 to 60 minutes to 1000° F. and then maintained at 1000° F. for an additional 5 hours. The results of this processing is given as Entry 1 of the following table entitled "Passivation of Metal Poisoned FCC Catalyst", hereinafter referred to as Table 1.

With respect to Entry 2 of TABLE 1, the catalyst of Entry 1 was further treated with a peroxide ($H_2O_2$) wash. The peroxide wash treatment comprised forming a 20% by weight slurry of the treated catalyst in a 5% by weight peroxide solution. The overall weight of peroxide per weight catalyst was about 10 to 20 pounds of peroxide ($H_2O_2$) per ton of catalyst. The time required for the peroxide treatment was 2 to 5 minutes of agitation followed by a water rinse and an oven drying as described above. The results of this processing is given as Entry 2 of TABLE 1.

With respect to Entry 3 of TABLE 1, at regenerated Phillips Borger equilibrium catalyst of Entry 1 was water washed. Water washing comprised forming a 20% by weight slurry with agitation. The time for contacting the catalyst with water is kept brief so as to avoid redeposition of solubilized vanadium onto the catalyst. The water washed catalyst was then air dried in an oven for about 12 hours at a temperature in the range of about 176° to 212° F., 20 grams of the oven dried catalyst was then suspended with agitation in a toluene solution comprising 0.73 grams of $(C_2H_5)_3Al$ and 80 grams of toluene. The agitation was continued for 20 minutes under $N_2$ and the toluene solution temperature was about 72° F. The catalyst was then separated from the toluene phase by evaporation and air dried in an oven for about 12 hours at a temperature in the range of about 200° to about 250° F. The oven dried catalyst was then calcined by heating in an oven which was at a temperature of about 1100° F. for about 4 hours. The calcined catalyst was then treated with a peroxide ($H_2O_2$) solution in the manner described with respect to Entry 2. The results of this processing is shown in TABLE 1 as Entry 3.

With respect to Entry 4, a Phillips Borger equilibrium catalyst which on regeneration had a metals contamination of 0.46% by weight nickel, 0.37% by weight iron, and 1.67% by weight vanadium as based on the total weight of catalyst and had a catalytic activity of 55.3 MA, 5.10 CPF, and 30.6 $H_2/CH_4$, was treated with an aqueous solution of aluminum sulfate. 20 grams of this catalyst was suspended with agitation in an aluminum sulfate solution consisting of 4.74 grams of aluminum sulfate $Al_2(SO_4)_3.9H_2O$ and 100 grams of water. The temperature of the aluminum sulfate solution was 176° F., and the agitation was continued for 30 minutes. The catalyst was isolated by filtration and dried in an air oven as described above and calcined at 1100° F. for 6 hours. The results of this processing is shown in TABLE 1 as Entry 4.

The treated catalyst of Entry 4 was further calcined by heating at 1300° F. for 4 hours. The results of this processing is shown in Entry 5.

With respect to Entry 6, the catalyst of Entry 5 was treated with a peroxide ($H_2O_2$) wash as described above.

TABLE 1

Passivation of Metal Poisoned FCC Catalyst
Feed Catalyst: Phillip's Borger Equilibrium Catalyst
Passivating Agent: $Al_2O_3 . xH_2O$

| | % Metal | | | | Cat. Activity | | |
|---|---|---|---|---|---|---|---|
| Entry | Ni | Fe | V | Ce | MA | CPF | $H_2/CH_4$ |
| 1 | 0.32 | 0.70 | 0.52 | 0.10 | 66.2 | 1.58 | 8.34 |
| 2 | 0.33 | 0.71 | 0.52 | 0.10 | 71.1 | 1.27 | 7.09 |
| 3 | 0.33 | 0.73 | 0.54 | 0.10 | 69.8 | 1.51 | 7.36 |
| 4 | 0.13 | 0.35 | 0.49 | 0.40 | 73.7 | 2.25 | 17.8 |
| 5 | 0.13 | 0.34 | 0.50 | 0.40 | 76.1 | 1.80 | 16.6 |
| 6 | 0.12 | 0.32 | 0.37 | 0.42 | 75.2 | 1.70 | 8.64 |

EXAMPLE II

Forty grams of the regenerated equilibrium catalyst were treated in an aqueous solution of aluminum nitrate, 4.5 grams of $Al(NO_3)_3.9H_2O$ dissolved in 100 milliliter (ml) of water. The atomic ratio of Al in solution to total metal contaminants in the catalyst was approximately 2:1. The slurried mixture was vigorously agitated on a shaker under reflux conditions for 20 minutes. The initial pH of the system, 2.86 increased to 3.05 during this treatment. The resulting system was filtered washed thoroughly with water until the presence of aluminum in the filtrate was no longer observed. The catalyst treated in this manner was dried under a high vacuum at 248° F., and further calcined at 1100° F. for 6 hours. Catalytic activities for the dried and dried-calcined catalyst are listed as 1a and 2a, respectively in TABLE 2.

The same procedure was employed, but with an aqueous solution of $Al_2(SO_4)_3$ at ambient temperatures for 1 hour. The pH of the system was 3.46 before the filtration was made. The catalyst, washed thoroughly, was calcined at 950° F. for 4 hours. The results are listed in 2 of TABLE 2.

TABLE 2

| | % Metal | | | | Catalyst Activity | | |
|---|---|---|---|---|---|---|---|
| | Ni | Fe | V | Ce | MA | F | $H_2/CH_4$ |
| 1a | 0.32 | 0.76 | 0.68 | 0.10 | 71.78 | 1.90 | 11.74 |
| 2a | 0.33 | 0.77 | 0.69 | 0.10 | 70.72 | 2.16 | 13.62 |
| 2 | 0.33 | 0.75 | 0.68 | 0.10 | 73.0 | 2.27 | 14.48 |

EXAMPLE III

Phillips Borger Equilibrium catalyst such as used in EXAMPLE I was treated with carbon tetrachloride solution of aluminum isopropoxide, $Al(iPrO)_3$.20 g of the equilibrium catalyst was slurried in 70 ml solution of $Al(iPrO)_3$, which contained 1.30 g $Al(PriO)_3$ dissolved in 70 ml $CCl_4$. The system was agitated on the shaker slurry at ambient temperature (about 72° F.) for two hours, and $CCl_4$ was evaporated off to obtain dried solid catalyst. The resulting catalyst was further calcined at 1000° F. for six hours. Results are listed as Entry 1 of TABLE 3.

EXAMPLE IV

The Phillips Borger equilibrium catalyst of EXAMPLE I was treated with a toluene solution of tri-isobutyl aluminum. 20 g of the equilibrium catalyst was vigorously agitated in a solution containing 1.28 g of $(iBu)_3$ Al dissolved in 70 ml toluene, under an inert atmosphere of $N_2$ for 20 minutes. Toluene was evaporated to yield a solid catalyst. This catalyst was isolated and later calcined at 1100° F. for six hours. Results are shown as Entry 2 of TABLE 3. The calcined catalyst was further tested with an aqueous solution of $H_2O_2$ twice (50#$H_2O_2$/ton catalyst) at 185° F. for 4 minutes. The resulting catalyst was dried. The catalytic activity and metal levels were determined. The results are summarized in 3 of TABLE 3.

TABLE 3

| | % Metal | | | | Catalyst Activity | | |
|---|---|---|---|---|---|---|---|
| | Ni | Fe | V | Ce | MA | F | $H_2/CH_4$ |
| 1. | 0.34 | 0.75 | 0.71 | 0.10 | 67.7 | 2.09 | 16.21 |
| 2. | 0.32 | 0.74 | 0.69 | 0.10 | 63.9 | 2.10 | 17.36 |
| 3. | 0.32 | 0.70 | 0.54 | 0.10 | 72.3 | 1.23 | 10.56 |

TABLE 3-continued

| | % Metal | | | | Catalyst Activity | | |
|---|---|---|---|---|---|---|---|
| | Ni | Fe | V | Ce | MA | F | $H_2/CH_4$ |
| 4. | 0.33 | 0.73 | 0.54 | 0.10 | 69.8 | 1.51 | 7.36 |

EXAMPLE V

The same Phillips Borger equilibrium catalyst of EXAMPLE I was water washed after calcination to remove free $V_2O_5$ and dried under a high vacuum at 248° F. Dried catalyst (20 g) was slurried in a toluene solution of ethylaluminum sesquichloride, 0.78 g $Et_3Al_2Cl_3$ in 60 mls of toluene and allowed to interact for 30 minutes at ambient temperature (72° F.) under a $N_2$ stream. Toluene was then evaporated to yield a treated catalyst which was calcined at 1100° F. for 4 hours and was further washed with an aqueous $H_2O_2$ solution. Results are listed as Entry 4 of TABLE 3.

EXAMPLE VI

In a plant, a metal passivation operation is carried out in connection with an FCC process to mitigate the detrimental effect of metals such as nickel, iron, vanadium, and copper. In the first cracking regeneration zone, which is a heavy oil cracking unit, 54,800 barrels per stream day of reduced crude oil are cracked. The reduced crude oil is topped North Slope crude and it contains about 23 ppm nickel and 48 ppm vanadium. An oil solution of aluminum isopropoxide is injected for passivation purposes into the fixed stream to this heavy oil cracker.

As a general rule, the atomic ratio of aluminum compound injected, calculated as elemental aluminum, to the contaminating metals introduced into the process by ways of the feedstock is 1.

The cracked product withdrawn from the cracking unit is introduced into a separator in which this product stream containing some cracking catalyst fines is separated into hydrocarbons that are essentially free of catalyst fines.

The hydrogen production, as well as coke formation, are significantly reduced by this process and the gasoline yields are increased. The same catalyst can be operated at higher levels of metal contaminants without sacrificing yield and selectivity of desired liquid products for a prolonged period.

The embodiments of this invention in which an exclusive property or privilege is claimed are defined as follows:

1. In a process for converting a hydrocarbon material having at least one metal contaminant selected from the group consisting of nickel, vanadium, iron and copper which comprises contacting the hydrocarbon material in a reaction zone at hydrocarbon conversion conditions with a catalyst containing a catalytically effective amount of at least one zeolite and about 0.75% to about 2% by weight of all of said metal contaminant to form a conversion product and a deactivated catalyst having carbonaceous deposits and containing at least a portion of said metal contaminant, and regenerating at least a portion of said deactivated catalyst to restore at least a portion of its catalytic activity by removing at least a portion of said carbonaceous deposits to form a regenerated catalyst, the improvement which comprises: contacting at least a portion of said regenerated catalyst with a liquid medium containing an effective amount of an aluminum compound for passivating at least a portion of said at least one metal contaminant for a time sufficient to permit at least a portion of aluminum atoms from said aluminum compound to transfer to at least a portion of said regenerated catalyst without removal of said at least one metal contaminant to form a treated catalyst containing aluminum atoms from said aluminum compound, and transferring at least a portion of said treated catalyst to said reaction zone, whereby said treated catalyst has an improved catalytic activity beyond that otherwise achieved by removal of an equivalent amount of metal contaminants, if any, removed by the claimed process.

2. The improved process of claim 1 wherein the liquid medium is water substantially free from any contaminating metal.

3. The improved process of claim 1 wherein the liquid medium is an organic medium capable of dissolving at least a portion of said at least one aluminum-containing material.

4. The improved process of claims 1, 2 or 3 wherein at least a portion of said treated catalyst is calcined prior to being transferred to said reaction zone.

5. In a process for converting a hydrocarbon material having at least one metal contaminant selected from the group consisting of nickel, vanadium, iron and copper which comprises contacting the hydrocarbon material in a reaction zone at hydrocarbon conversion conditions with a catalyst containing a catalytically effective amount of at least one zeolite and containing about 0.75% to about 2% by weight of all of said metal contaminants to form a conversion product and a deactivated catalyst having carbonaceous deposits and containing at least a portion of said metal contaminant, and regenerating at least a portion of said deactivated catalyst to restore at least a portion of its catalytic activity by removing at least a portion of said carbonaceous deposits to form a regenerated catalyst, the improvement which comprises: contacting said regenerated catalyst with an aqueous solution having a pH in the range of about 2 to about 5 containing an effective amount of an aluminum compound passivating at least a portion of said metal contaminant therein, changing the pH of said aqueous solution to a value which will induce at least a portion of said aluminum compound to deposit on said regenerated catalyst, thereby forming a treated catalyst without removal of said at least one metal contaminant containing aluminum atoms from said aluminum compound, and transferring at least a portion of said treated catalyst to said reaction zone, whereby said treated catalyst has an improved catalytic activity beyond that otherwise achieved by removal of an equivalent amount of metal contaminants, if any, removed by the claimed process.

6. In a process for converting a hydrocarbon material having at least one metal contaminant selected from the group consisting of nickel, vanadium, iron and copper which comprises contacting the hydrocarbon material in a reaction zone at hydrocarbon conversion conditions with a catalyst containing a catalytically effective amount of at least one zeolite and containing about 0.75% to about 2% by weight of all of said metal contaminants to form a conversion product in a deactivated catalyst having carbonaceous deposits and containing at least a portion of said metal contaminants, and regenerating at least a portion of said deactivated catalyst to restore at least a portion of its catalytic activity by removing at least a portion of said carbonaceous deposits to form a regenerated catalyst, the improvement which comprises: contacting at least a portion of said regenerated catalyst with an organic medium containing an effective amount of an aluminum compound at least partially dissolved therein, seperating a treated catalyst without removal of said at least one metal contaminant, from said organic medium wherein at least a portion of the aluminum compounds from said medium have been deposited on said treated catalyst and transferring at least a portion of said treated catalyst to said reaction zone, whereby said said treated catalyst has an improved catalytic activity beyond that otherwise achieved by removal of an equivalent amount of metal contaminants, if any, removed by the claimed process.

7. The improved process of claims 5 or 6 wherein at least a portion of said treated catalyst is calcined prior to being transferred to said reaction zone.

8. In a process for converting a hydrocarbon material having at least one metal contaminant selected from the group consisting of nickel, vanadium, iron and copper which comprises contacting the hydrocarbon material in a reaction zone at hydrocarbon conversion conditions with a catalyst containing a catalytically effective amount of at least one zeolite and containing about 0.75% to about 2% by weight thereof of all of said metal contaminants to form a conversion product and a deactivated catalyst having carbonaceous deposits and containing at least a portion of said metal contaminant, and regenerating at least a portion of said deactivated catalyst to restore at least a portion of its catalytic activity by removing at least a portion of said carbonaceous deposits to form a regenerated catalyst, the improvement which comprises: introducing into said hydrocarbon material an effective amount of at least one aluminum compound at least partially soluble in said hydrocarbon material and contacting said hydrocarbon material with said catalyst in said reaction zone, whereby aluminum atoms from said at least one aluminum compound become associated with said catalyst and help maintain the catalytic activity of said catalyst without removal of any of said at least one metal contaminant.

9. The improved process of claims 1, 3, 5 or 8 wherein said aluminum compound is selected from the group of such compounds consisting of diketonates, sulfonates, dithiophosphates, alkoxides, carboxylates having from 1 to 20 carbon atoms, organic aluminum compound having the formula $R_3Al$ wherein each R is selected from a group consisting of hydrocarbyl and halogen substituted hydrocarbyl materials which can contain from 1 to 20 carbon atoms, organic aluminum halides having the formula $R_n AlX_{3-n}$ wherein n can have values of 1 or 2, and organic oxyaluminum having the formula $R_nAl(R'O)_{3-n}$ wherein each R and R' individually have from hydrocarbyl and halogen substituted hydrocarbyl which can contain 1 to 20 carbon atoms and n has an integer value of from 0 to 3, carbonyls, metallocenes, hydrocarbyl and halogen substituted hydrocarbyl phosphine and phosphite complexes wherein each has 1 to 20 carbon atoms, and olefin and diolefin complexes having from 2 to 20 carbon atoms, oxalate, acetate, $AlBr_3$, $AlI_3$, diethylmalonate and 1-phenylsulfonate.

10. The improved process of claims 1, 2, 5 or 8 wherein said aluminum compound is selected from the group of such compounds consisting of $Al(NO_3)_3$, $Al_2(SO_4)_3$, $AlPO_4$, $Al(C_6H_5O)_3$, $Al(Ac)_3$ wherein Ac is acetate, $(NH_4)Al(SO_4)_2$, $(Al(BrO_3)_3$, $Al(ClO_3)_3$, $Al(ClO_4)_3$, $Al(C_2H_5O)_3$, Al-lactate, Al-oleate and $AlX_3$ where each X is individually selected from the group of halogens consisting of F, Cl, Br and I.

11. In the improved process of claims 1, 2, 3, 5, 6 or 8 wherein said effective amount of said at least one aluminum compound is such that an atomic ratio of all aluminum atoms from said at least one aluminum compound to total atoms from said metal contaminant contained in said treated catalyst is in the range of about 0.05:1 to about 3:1.

12. In the improved process of claim 8, wherein said effective amount of said aluminum compound is such that an atomic ratio of all aluminum atoms from said at least one aluminum compound to all atoms of said metal contaminant in said hydrocarbon material is in the range of about 0.05:1 to about 3:1.

13. In the improved process of claims 1, 2, 3, 5, 6 or 8 wherein the effective amount of said aluminum, calculated as atomic aluminum, in moles per liter of liquid medium is within the range of about 0.03 to about 1 when the concentration of metal contaminant, calculated as its element, in the contaminated catalyst is in the range of about 0.2% by weight to about 3.5% by weight, as based upon the total weight of the catalyst.

* * * * *